US006871755B2

(12) United States Patent
DeVries et al.

(10) Patent No.: US 6,871,755 B2
(45) Date of Patent: Mar. 29, 2005

(54) TICKET COUNTING DISPENSER

(75) Inventors: Douglas E. DeVries, Johnston, IA (US); Trevor E. Meyer, Des Moines, IA (US); Kevin A. Jankowski, Ames, IA (US); Daniel J. Fahrion, Urbandale, IA (US); Scott A. Bottorf, Ankeny, IA (US)

(73) Assignee: Schafer Systems Inc., Adair, IA (US)

( * ) Notice: Subject to any disclaimer, the term of this patent is extended or adjusted under 35 U.S.C. 154(b) by 91 days.

(21) Appl. No.: 10/230,711

(22) Filed: Aug. 29, 2002

(65) Prior Publication Data

US 2004/0044437 A1 Mar. 4, 2004

(51) Int. Cl.[7] ..... G07F 11/00
(52) U.S. Cl. ..... 221/7; 225/10
(58) Field of Search ..... 221/2, 7, 6, 13, 221/9; 225/10, 32, 100; 235/375

(56) References Cited

U.S. PATENT DOCUMENTS 3,978,958 A 9/1976 Zandstra
4,398,708 A * 8/1983 Goldman et al. ..... 270/18
4,982,337 A 1/1991 Burr et al.
5,222,624 A 6/1993 Burr
5,383,572 A 1/1995 Mrajca
6,302,292 B1 10/2001 Schafer et al.
2001/0049986 A1 * 12/2001 Roberts et al. ..... 83/13

* cited by examiner

*Primary Examiner*—Kenneth W. Noland
(74) *Attorney, Agent, or Firm*—G. Brian Pingel; Camille L. Urban

(57) ABSTRACT

A storage, display and dispensing apparatus for tickets of various sizes that accounts for the tickets dispensed during a selected time period. The apparatus includes a bin housing for storing a pack of tickets, a ticket dispensing assembly through which the tickets are dispensed and includes a friction wheel assembly that is actuated as tickets pass through the ticket dispensing assembly. An optical sensing element is also employed to sense indicia on the tickets to coact with the friction wheel assembly to provide a ticket count.

17 Claims, 19 Drawing Sheets

TICKET COUNTING DISPENSER

BACKGROUND OF THE INVENTION

1. Field of the Invention

The present invention relates in general to apparatus for the display and dispensing of lottery tickets and more specifically to such apparatus that has the ability for counting the lottery tickets that are dispensed and maintaining a record thereof.

1. Description of the Prior Art

Numerous states throughout the United States have implemented a variety of lottery games as a generating means of additional revenue for the state. One of the more popular types of lottery games that are offered is what are commonly referred to as instant lottery games. Tickets for instant lottery games are preprinted and upon their purchase, the purchaser can determine relatively quickly whether they are a winner of a prize.

Lottery tickets are sold in a variety of retail establishments and are commonly found in grocery stores and convenience stores. Lottery tickets in many cases are dispensed manually by the simple process of detaching a ticket or tickets from a ticket pack, according to the requirements of the ticket purchaser. However, with a variety of different types of instant lottery games now being offered it has become common place for establishments selling such tickets to use different types of ticket display and dispensing devices for the tickets.

The retailer who sells a lottery ticket receives only a small portion of the ticket price. Accordingly, it is highly important for the retailer to accurately account for each ticket that is received and sold. Most common ticket display and dispensing devices on the market today do not provide the ability to in any way keep track of the tickets that are dispensed therefrom and it is necessary for the retailers using such devices to utilize manual accounting systems for keeping track of tickets that are sold from their establishments.

As a means of providing an efficient and effective device for the dispensing and accounting of lottery tickets that are sold, various types of lottery ticket vending machines have been developed as disclosed in U.S. Pat. Nos. 5,383,572; 3,978,958; 4,982,337; and 5,222,624. Although such vending devices appear to be highly efficient in dispensing and accounting for the lottery tickets sold, they are expensive to purchase, are relatively complex to operate and maintain, and take up more space than is normally available for ticket dispensing devices.

Several companies have just recently begun advertising and offering new types of ticket vending devices used as means for maintaining an accurate accounting of the tickets dispensed. Both Interlott Technologies, Inc. and On-point Technology Systems, Inc. now offer such display and vending devices. U.S. Pat. No. 6,302,292 B1 discloses yet another type of ticket counting apparatus that utilizes a friction wheel for monitoring the amount of ticket travel to maintain a ticket count, and a stress sensing means that detects the perforations between the tickets to verify the ticket count provided by the friction wheel.

The present invention is an alternative to the type of devices offered by Interlott Technologies and On-point Technology Systems and also is designed to provide a more efficient system of ticket counting that is not dependent upon perforation sensing. Furthermore, the present invention is designed to provide a relatively inexpensive but highly efficient means for accurately maintaining a count of those lottery tickets that are dispensed at a particular retail establishment.

SUMMARY OF THE INVENTION

The present invention provides for the storage, display and dispensing of various types of tickets, preferably lottery tickets, and to account for tickets dispensed from the apparatus. The ticket dispensing apparatus of the present invention includes a bin housing for storing a pack of tickets, a tear bar bin assembly through which the tickets are dispensed from the bin housing and first and second ticket counting means associated with a tear bar bin assembly for providing an accurate count of the tickets dispensed from the apparatus.

The first ticket counting means is associated with the tear bar assembly and is preferably in the form of a friction wheel that presses against the tickets as they pass through such assembly and provides electronic signals representative of the number of tickets passing therethrough. The second ticket counting means is also associated with the tear bar bin assembly and preferably is adapted to sense printed indicia that represents a ticket as each ticket passes through such assembly to provide a ticket sensing signal that increases the accuracy of the first counting means. In this way, the accuracy of the dispensing apparatus is significantly improved so that the apparatus provides a highly cost efficient means for achieving an accurate ticket dispensing count.

Other objects, features, and advantages of the present invention will be readily appreciated as the same becomes better understood after reading the subsequent description taken in conjunction with the appendant drawings.

DETAILED DESCRIPTION OF THE PREFERRED EMBODIMENT

Figure 1:
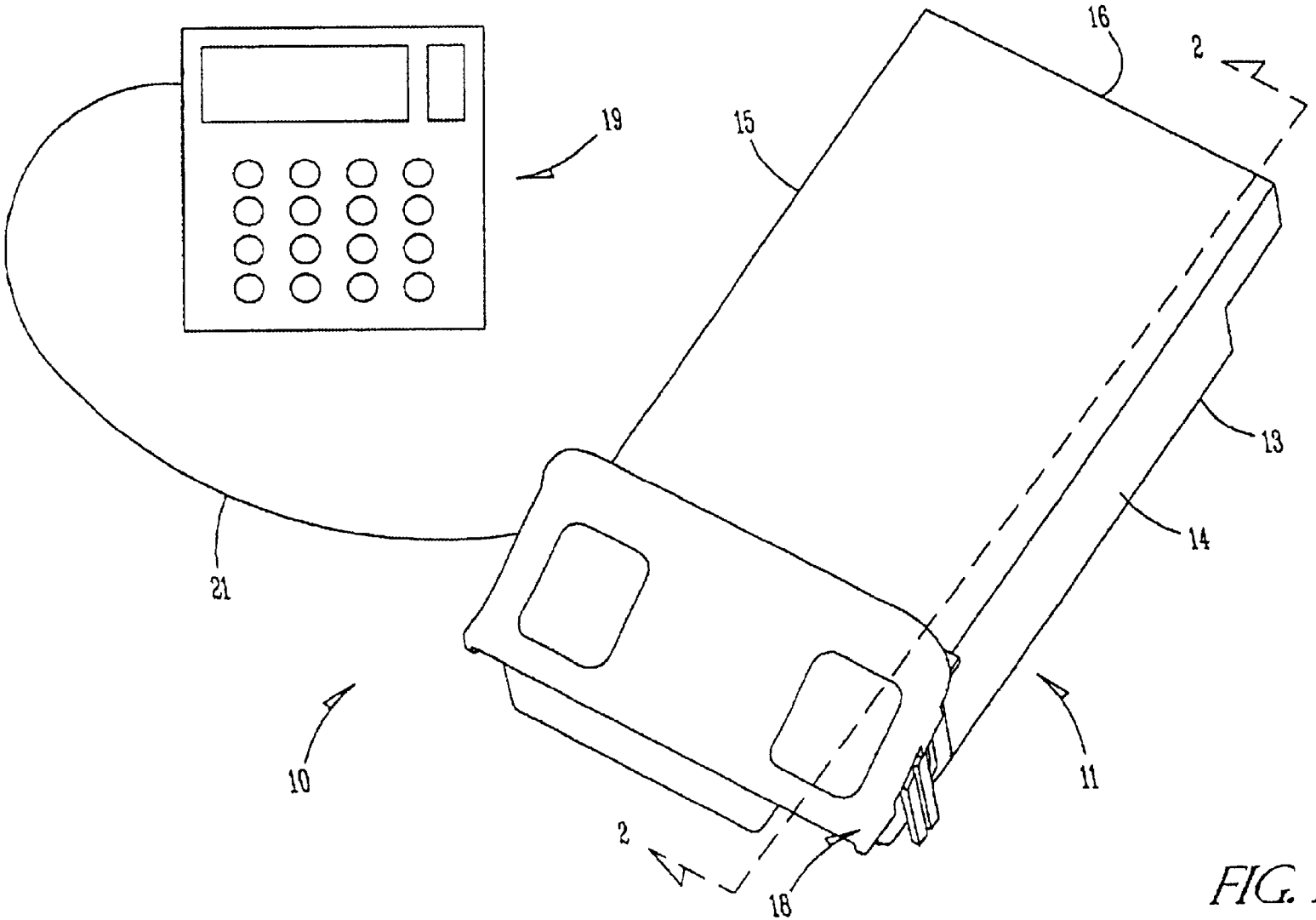
FIG. 1 is a front perspective view of a preferred embodiment of the dispensing apparatus of the present invention that includes a ticket bin together with a keypad and printer assembly.
Figure 2:
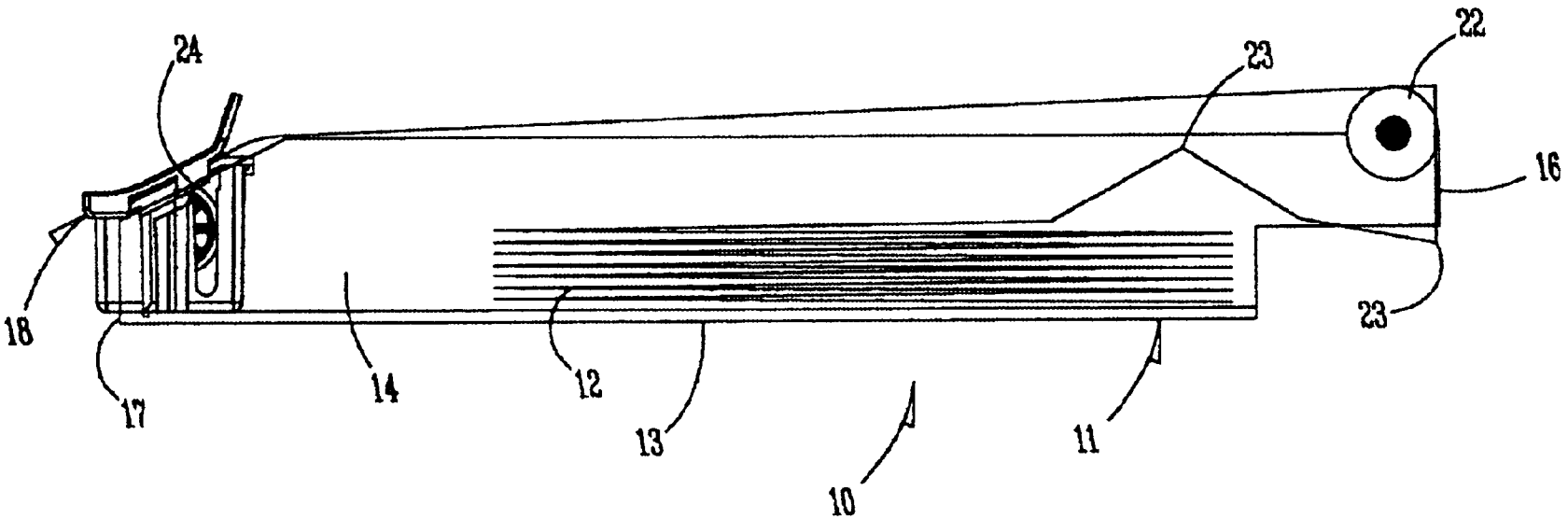
FIG. 2 is a cross-sectional view of the apparatus of FIG. 1 taken along the line 2—2 of FIG. 1.

The present invention provides an apparatus for the storage, display and dispensing of tickets and for the accounting of the tickets dispensed from the apparatus. Referring first to FIGS. 1 and 2, a preferred embodiment of the apparatus of the present invention is shown generally at 10 and is in the form of a generally rectangularly shaped bin 11 in which a pack of lottery tickets 12 (shown only in FIG. 2) is stored for the purpose of being dispensed therefrom. The bin 11 is not typically used by itself but instead is combined with a plurality of other bins 11 in a side-by-side and/or stacked relationship, with the plurality of bins 11 being enclosed in a transparent cover (not shown) to provide a ticket dispenser that contains lottery tickets for a variety of games.

The bin 11 includes a bottom wall 13, sidewalls 14 and 15 having rear ends that are stair-stepped, an open back end 16 and an open front end 17 for receiving a tear bar bin assembly 18. The bin 11 is used in conjunction with a master controller unit 19 in a separate housing that is electronically connected to the bin 11 via cable 21.

Located in the rear portion of the bin 11 is a guide roller 22 that is rotatably attached between the sidewalls 14 and 15. The lottery tickets 12 are in the form of a fanfold pack with the tickets 12 sequentially connected together by perforated joinder lines 23 that define the side edges of each ticket 12.

As shown in FIG. 2, the tickets 12 are trained around the guide roller 22 and extend along the top of the bin 11 to the tear bar bin assembly 18 so as to be displayed for viewing by potential customers. As is well-known in the art, when the bin 11 is utilized in combination with a plurality of other similar bins, all of which are secured in a housing with a preferably transparent top and front, the tickets 12 of the uppermost bins can be viewed by customers for attracting attention to the lottery games being offered in addition to serving as a means for providing a display of the tickets 12, of each game.

Figure 3:
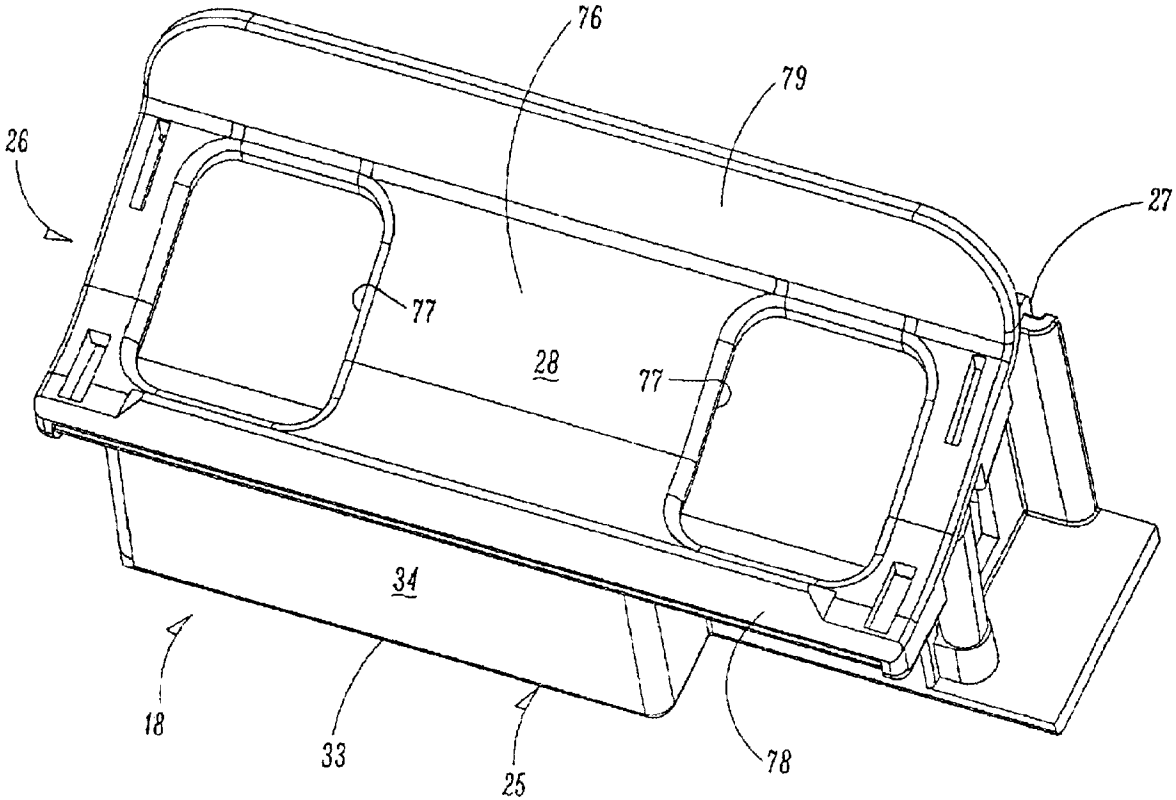
FIG. 3 is a perspective view of a tear bar bin assembly included in the apparatus of FIG. 1.
Figure 4:
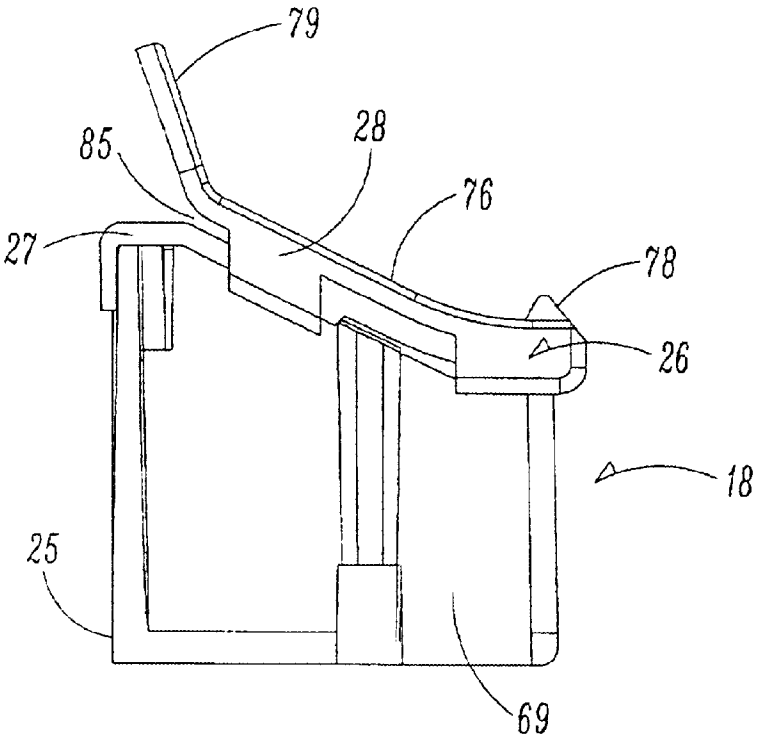
FIG. 4 is a side view in elevation of the bin assembly of FIG. 3.

A leading ticket 24 of the tickets 12 is threaded into the tear bar bin assembly 18 in a position for being dispensed. The tear bar bin assembly 18 serves as a ticket dispensing assembly and, as shown in FIGS. 3 and 4, is preferably formed with a base portion 25 and a two piece cover 26 that includes a lower guide ramp 27 and an upper guide ramp 28 that together serve as a guide means for the tickets 12 to control their travel so that they are maintained in a position for proper counting and verification of counting as will be described below.

Figure 5A:
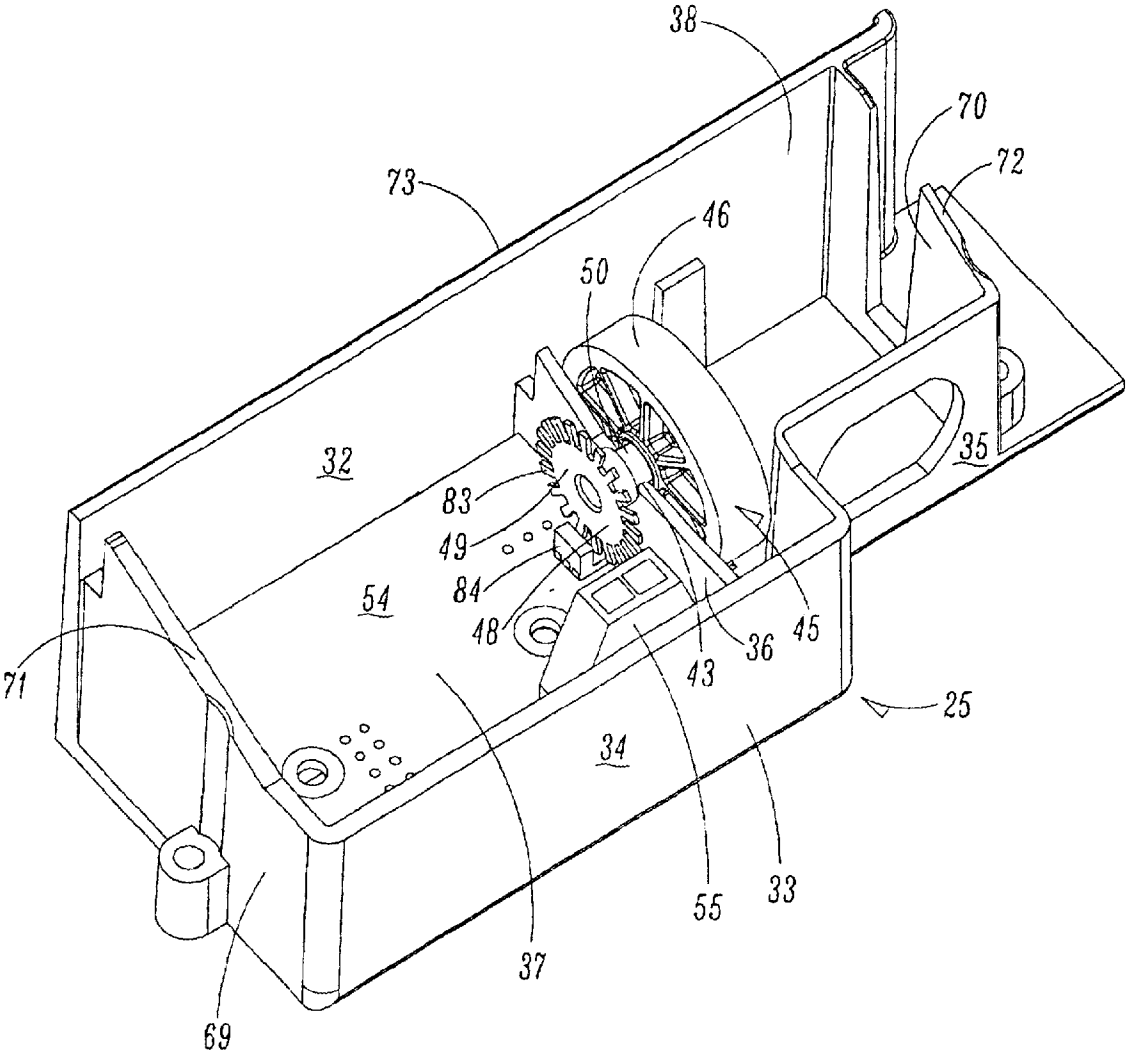
FIG. 5*a* is a perspective view of a base that forms part of the bin assembly of FIG. 3.
Figure 5B:
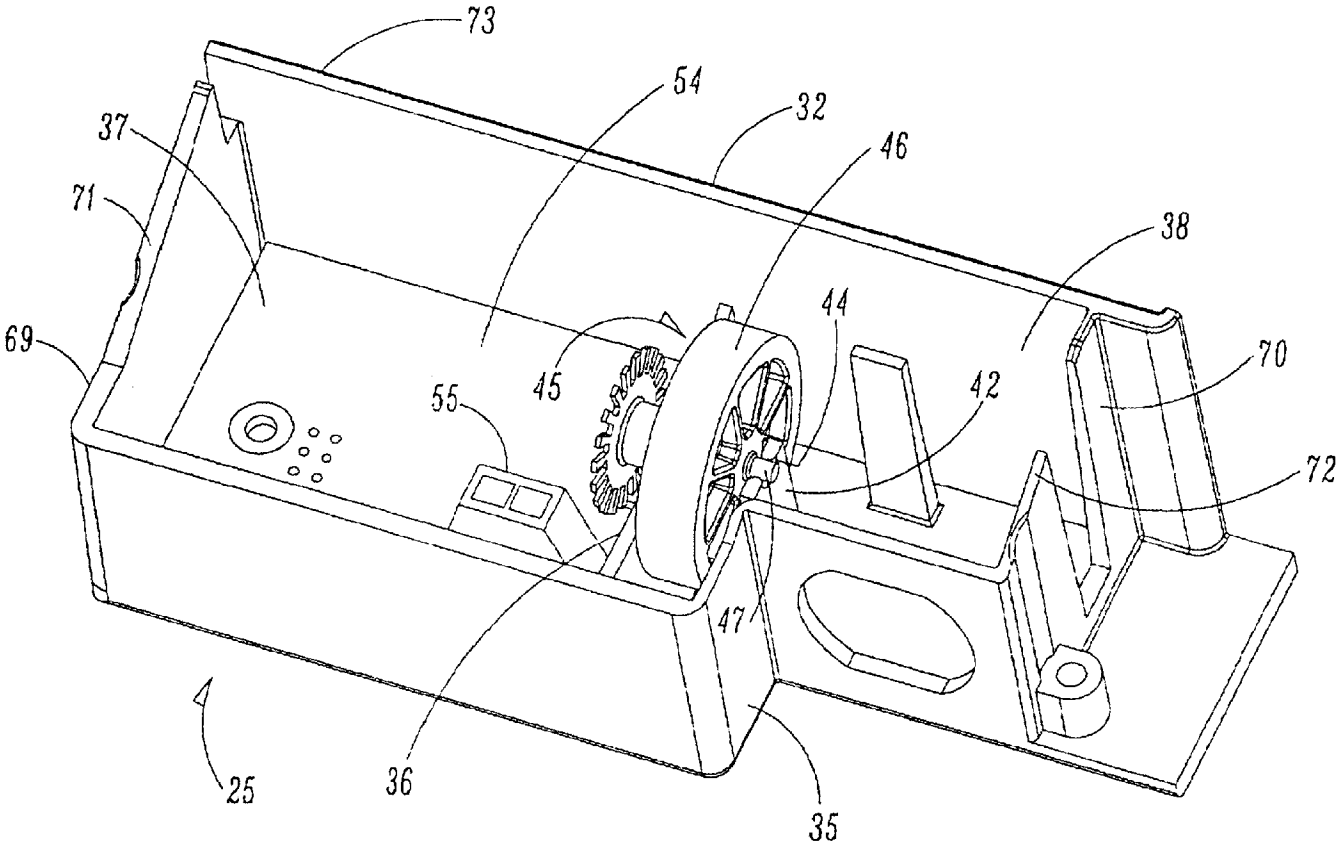
FIG. 5*b* is a second perspective view of the base of FIG. 5*a*.

Referring now to FIGS. 5*a* and 5*b*, the base 25 is generally tray shaped with a relatively straight back wall 32 and a front wall 33 with a straight portion 34 and a stair-stepped portion 35. Connecting between the front wall 33 and the back wall 32 is a cross member 36 that serves to partition the base 25 generally into a large base portion 37 and a smaller base portion 38. As shown only in FIG. 5*b*, projecting upward from the bottom of the base 25 is a strut 42 that is spaced apart from the partition 36. Both the upper portions of the partition 36 and the strut 42 have small arcuate recesses 43 and 44 respectively whereby the partition 36 and the strut 42 serve as trunnions for a friction wheel assembly 45.

Forming the assembly 45 is a friction wheel 46 having a medial axle 47 on one side and an encoder wheel assembly 48 on the opposite side, which encoder assembly 48 includes an encoder wheel 49 and a hub 50. The hub 50 fits in the recess 43 and the axle 47 fits in the recess 44 so that the friction wheel assembly 45 is rotatably supported by the partition 36 and the strut 42.

The large base portion 37 accommodates a printed circuit board 54 that contains the electronics (not shown) for the apparatus 10. Extending vertically upward from the printed circuit board 54 is an optical sensing element 55, which as known in the art emits a light beam and senses the amount of light reflected. The purpose of the element 55 will be described below.

Figure 6:
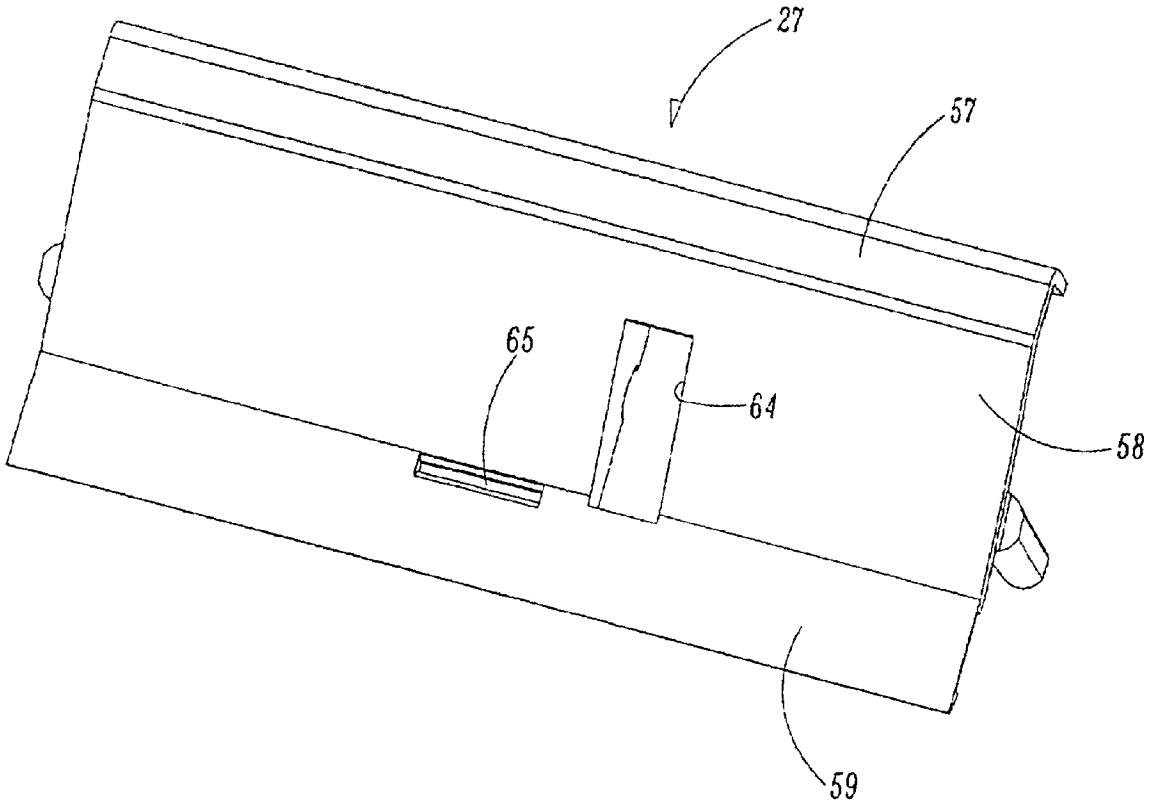
FIG. 6 is a perspective view of a lower ramp of the cover of FIG. 3.
Figure 7:
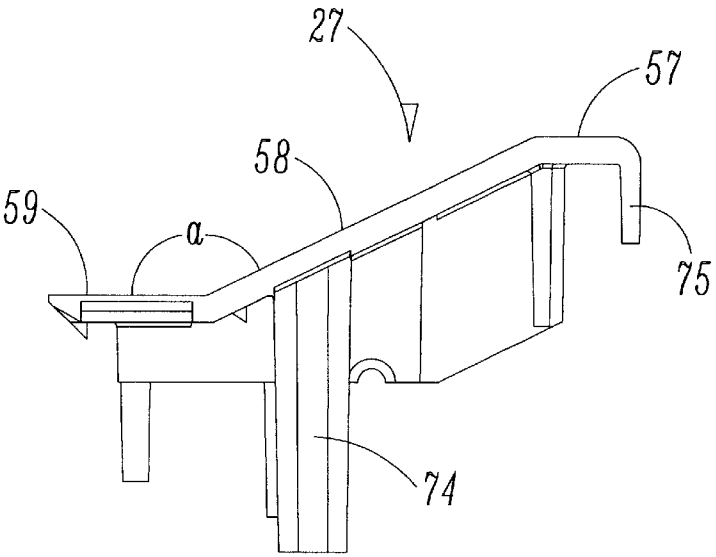
FIG. 7 is an end view in elevation of the lower ramp shown in FIG. 6.
Figure 8:
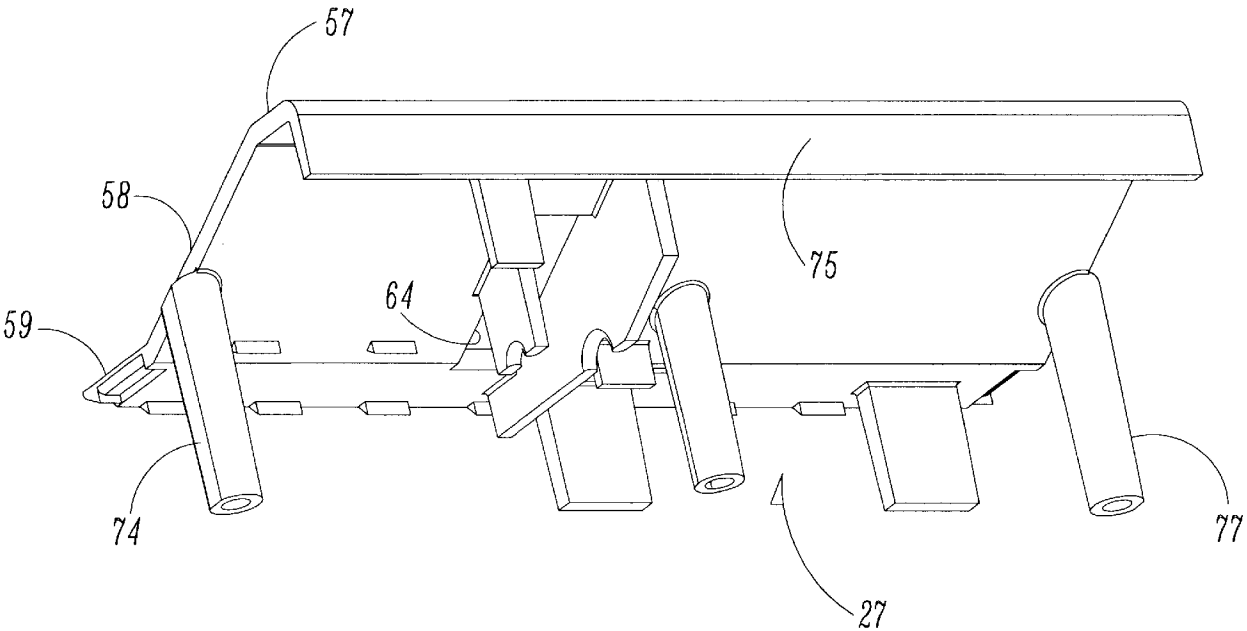
FIG. 8 is a bottom perspective view of the lower ramp of FIG. 6.
Figure 12:
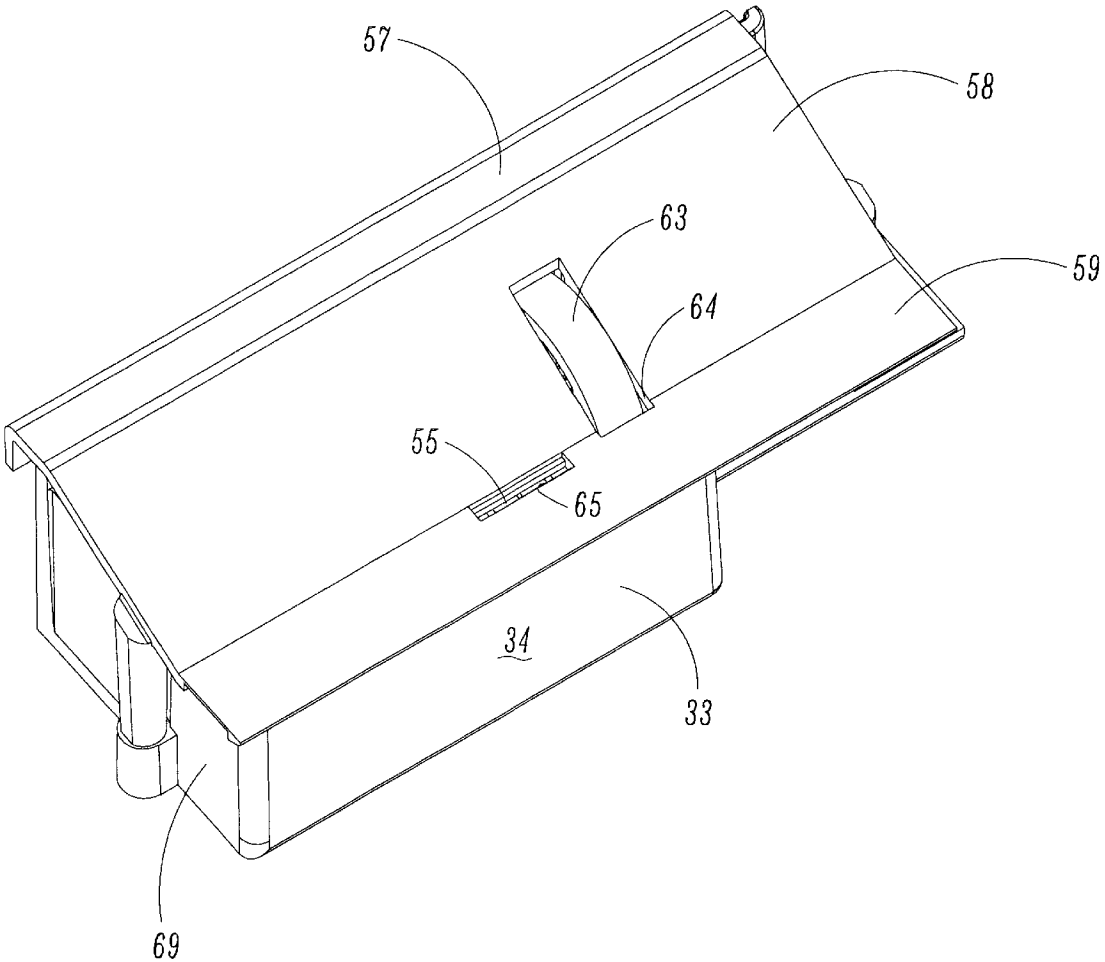
FIG. 12 is a top perspective view of the tear bar bin assembly with only the lower ramp of the cover mounted thereon.

Referring now to FIGS. 6, 7 and 8, the lower guide ramp 27 of the cover 26 is formed of three planer portions including a narrow top portion 57, a relatively wide middle portion 58 and a third lower portion 59. The top and lower portions 57 and 59 lie in planes generally parallel to that of the bottom of the bin 11, and the middle portion 58 is inclined with respect thereto on an angle alpha of preferably approximately one hundred fifty-four degrees, for a purpose as will be described below. Formed in the lower ramp 27 is a slot 64 aligned traversely to the longitudinal axis of such ramp and of a size corresponding to slightly larger than the friction wheel 46. Thus, the upper portion of the friction wheel 46 can extend partially through the slot 64, as indicated in FIG. 12, when the tear bar bin assembly 18 is fully assembled.

The lower guide ramp 27 also includes a narrow slit 65 (shown only in FIGS. 6 and 12) that is aligned with the optical sensing element 55 to permit the light beams from such element to be transmitted therethrough for a purpose as will be described below.

To connect the lower ramp 27 to the base 25, the base has end walls 69 and 70 with upper side ledges 71 and 72 that extend outwardly therefrom, and back ledges 73 that extend outwardly from the base back wall 32. The ledges 71, 72 and 73 all come into engagement with side flanges 74 and back flanges 75 that depend from the bottom surface of the lower ramp 27 to hold it in place on the base 25. Thus, the lower ramp 27 can be quickly and easily assembled on the base 25 by slidably engaging the flanges 74 and 75 of the lower ramp 27 with the ledges 71, 72 and 73 of the base 25.

Figure 9:
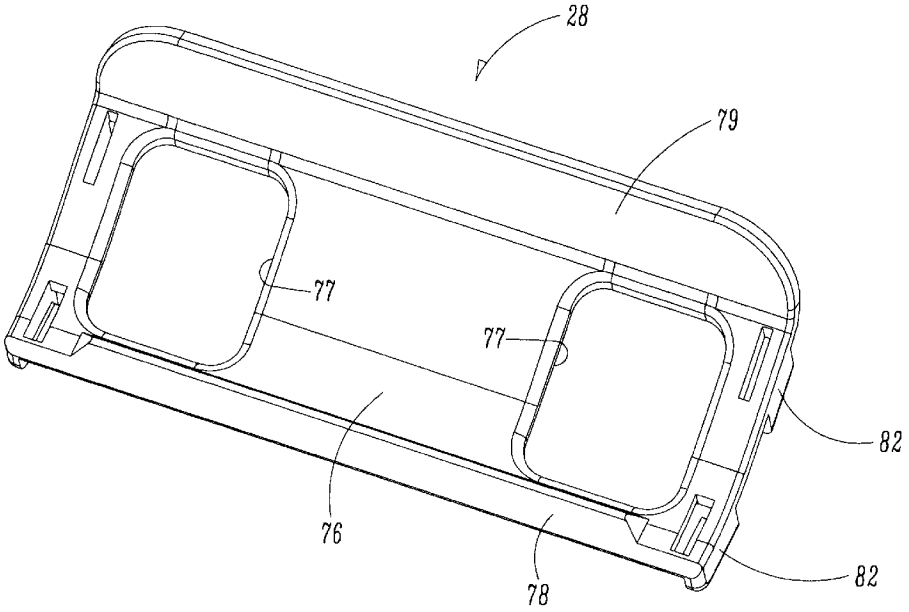
FIG. 9 is a top perspective view of an upper ramp that forms part of the cover shown in FIG. 3.
Figure 10:
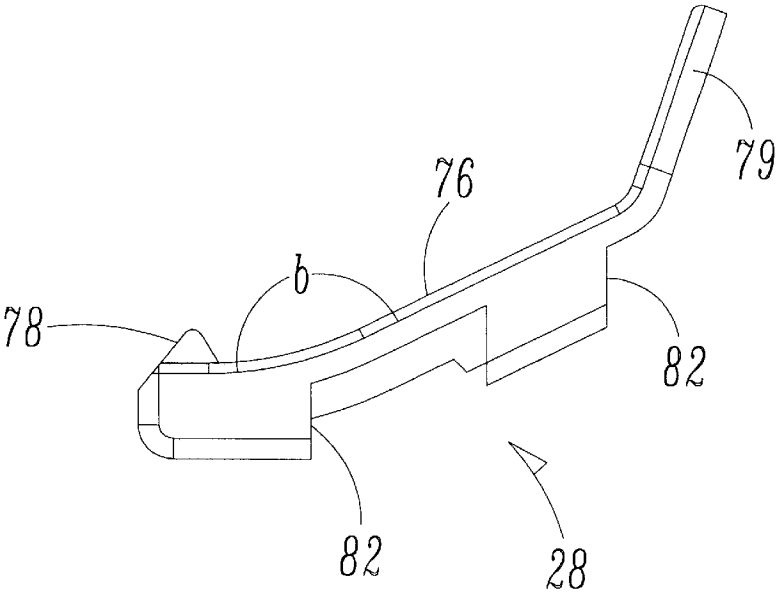
FIG. 10 is an end view in elevation of the upper ramp of FIG. 9.
Figure 11:
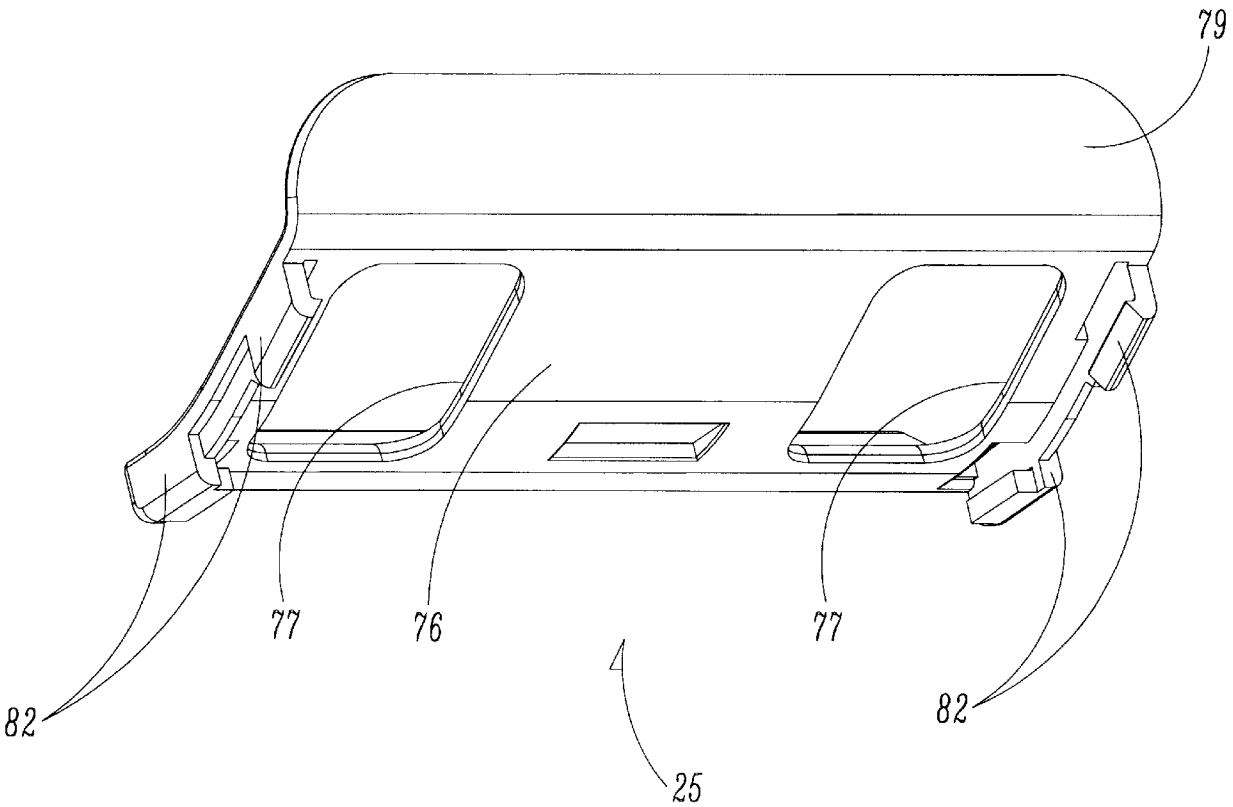
FIG. 11 is a bottom perspective view of the upper ramp of FIG. 9.

Referring now to FIGS. 9, 10 and 11, the upper guide ramp 28 of the cover 26 has a middle planer portion 76 that generally conforms to the shape of the middle portion 58 of the lower ramp 27 and has a pair of open windows 77 that allow a user to touch any lottery ticket 12 retained within the tear bar bin assembly 18. Similar to the lower ramp 27, the upper ramp 28 has a lower portion 78 that forms an angle beta with the middle portion 76 comparable to the angle alpha formed by the middle and lower portions of the lower ramp 27.

The side edges of the upper ramp middle portion 76 have downwardly depended L-shaped flanges 82 that are sized for engagement with the side edges of the lower ramp 27 for assembly of the two ramp portions 27 and 28 together to form the cover 26.

The upper guide ramp 28 further includes an upper portion 79 that extends generally in a direction perpendicular to the bin bottom wall 13. Thus, when the ramps 27 and 28 are assembled together, their top segments form a guiding funnel type structure to direct the end most ticket 24 between the ramps 27 and 28, which when attached together, form a narrow passageway 85 (see FIG. 4) through which the tickets 12 can be guided and directed for dispensing from the apparatus 10. As the tickets 12 pass through the tear bar bin assembly 18 to be dispensed, they engage the friction wheel assembly 45 and are scanned by light beams from the optical sensing element 55 to provide a counting operation of the tickets dispensed for the apparatus 10 as will now be described.

Preferably, the counting operation of the apparatus 10 is principally dependent upon the frictional engagement of the friction wheel 46 with the tickets 12. Movement of the tickets 12 through the tear bar bin assembly 18 causes rotation of the friction wheel assembly 45, including the encoder wheel 49 to provide ticket dispensing information to the electronic circuitry of the apparatus 10 located on the printer circuit board 54.

Figure 13:
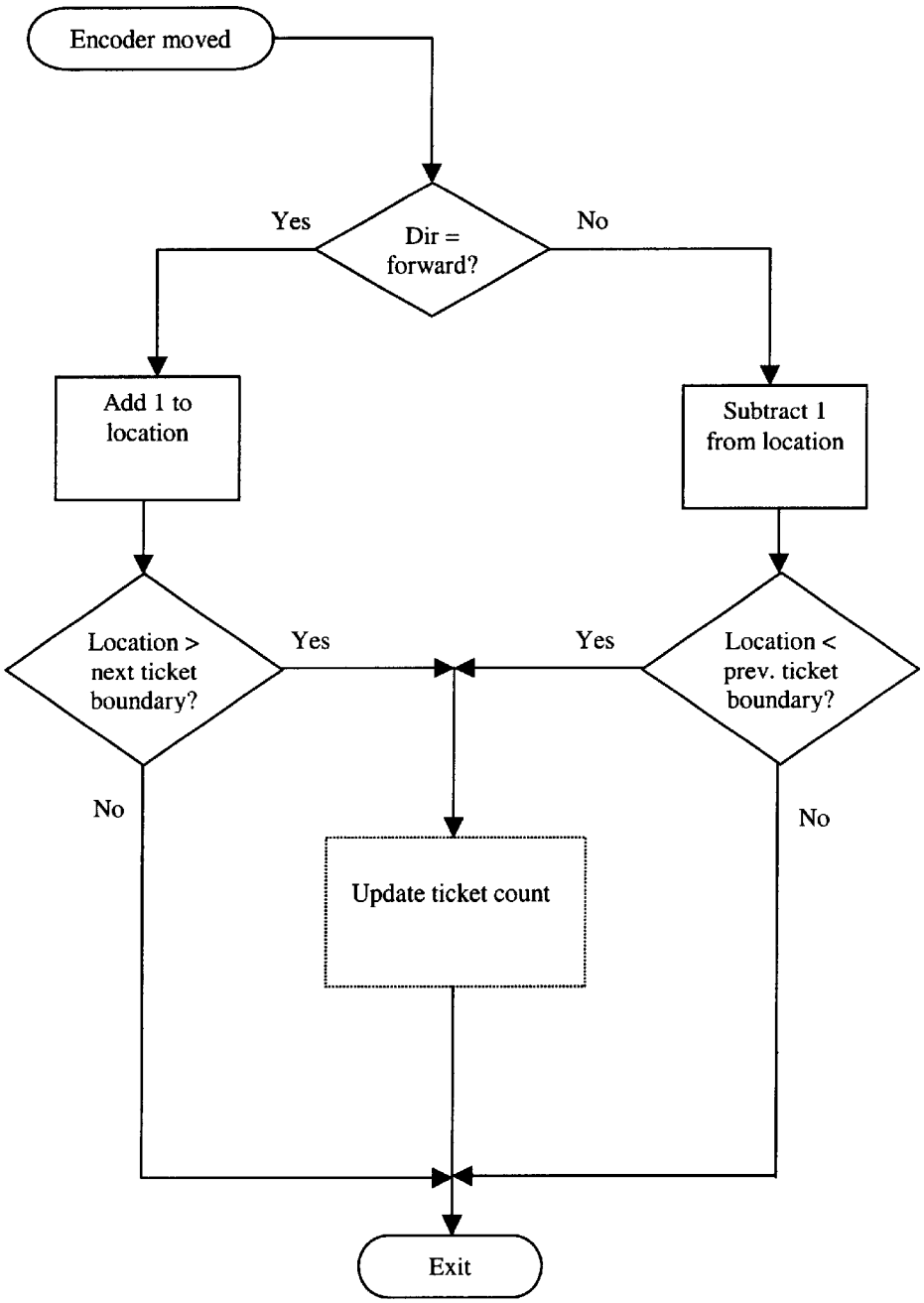
FIG. 13 is a flow chart showing an encoder movement algorithm to account for the direction of ticket travel that is sensed by the apparatus of FIG. 1.

As can be best seen in FIG. 5A, the encoder wheel 49 is of a spoked configuration 83 and is positioned between a light emitting diode and two optical sensors of an emitter detector assembly 84 which serves to translate rotation of the friction wheel 46 into electronic signals indicative of the number of lottery tickets that are dispensed from apparatus 10. By using the emitter detector assembly 84 with two optical sensors the leading and trailing edges of the encoder wheel spokes 83 can be sensed in order that the apparatus 10 can distinguish between the direction of movement of the tickets 12. To insure that an accurate ticket count is provided by the apparatus 10, it is critical for the apparatus 10 to account for the direction the encoder wheel 49 is turning because there are times when tickets may be pulled out of the apparatus 10 and then pushed back in without being torn apart and dispensed. Thus, if tickets 12 are being pulled out of the apparatus 10, the encoder wheel count should increase whereas the count should decrease if the tickets 12 are pushed back into the apparatus 10, as provided by the encoder movement algorithm (EMA) shown in FIG. 13. To accomplish this, the EMA either increments or decrements the encoder wheel count, based on the direction of travel of the wheel 49.

If the friction wheel assembly 45 is used as the primary ticket counting means, the EMA also checks to see if the current encoder count (location) has surpassed a ticket boundary. If so, it increments or decrements the ticket count, depending on the direction of travel, and calculates the new ticket boundary in each direction, based on the ticket width. Thus, the use of the encoder wheel 49 provides a means of measuring ticket travel through the tear bar bin assembly 18 via the use of a plurality of counts for each inch of rotation of the friction wheel 46 so that a highly precise measurement is provided through the small increments being measured.

Figure 14:
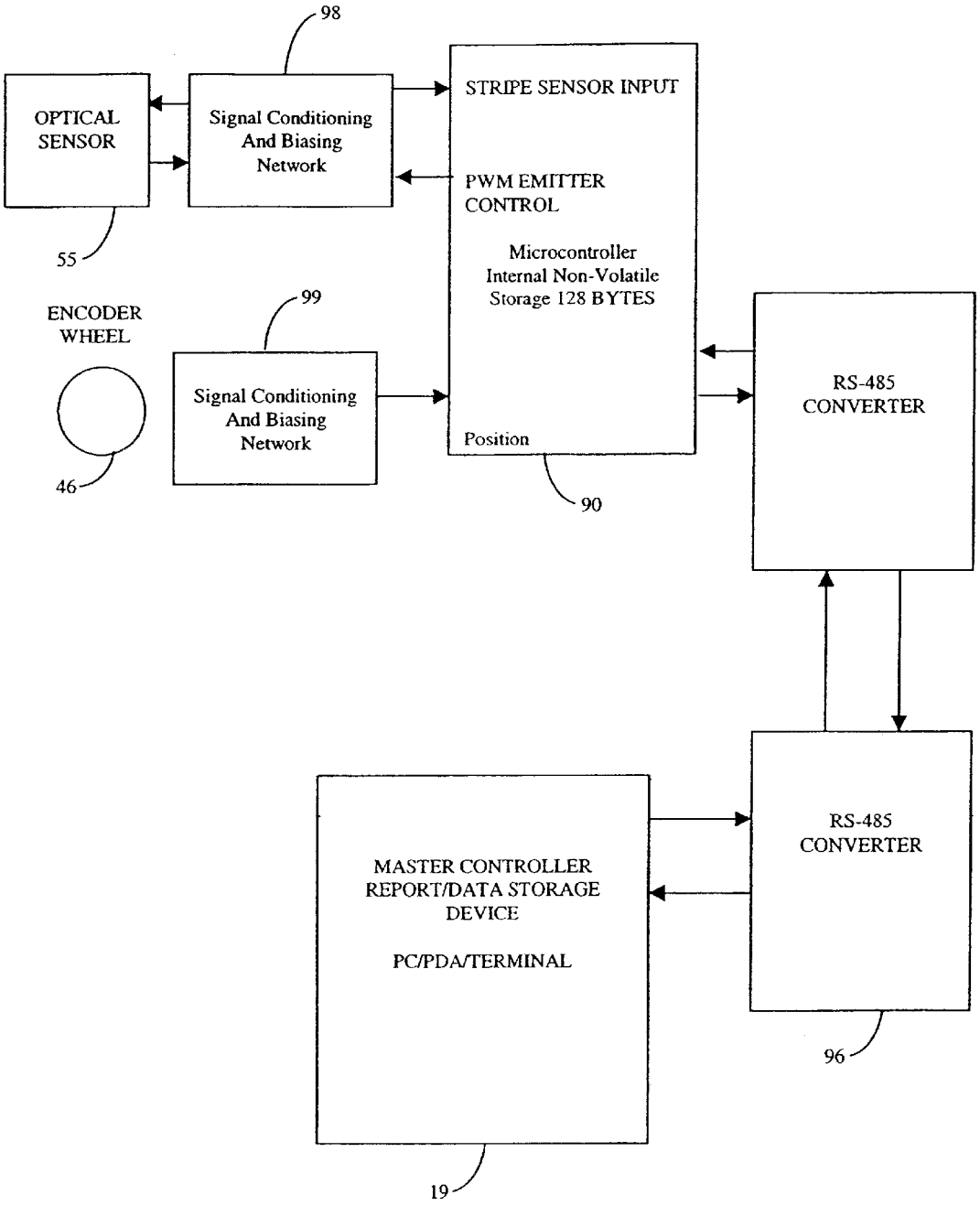
FIG. 14 is a block diagram of the electrical circuitry of the apparatus of FIG. 1.

Prior to dispensing of any of the tickets 12 from the bin 11, information about the tickets 12 is programmed into a bin microcontroller 90 included on the printed circuit board 54 through the use of the master controller 19, as indicated in the block diagram of FIG. 14. The master controller 19 preferably has a keypad with a liquid crystal display for performing this programming, which includes the type of game the tickets 12 are for, the ticket length and the number of tickets 12 in the pack.

The master controller 19 further preferably includes a printer, a master central processing unit and a memory storage means. RS-485 converters 96 and 97 are employed to permit the master controller 19 to communicate with the electronics of the bin 11, which are located in the tear bar bin assembly 18 and co-act with the encoder wheel 49 and the optical sensing element 55. Associated with the microcontroller 90 are signal conditioning and biasing networks 98 and 99 for the sensor 55 and the encoder wheel 46 respectively, all located on the printed circuit board 54.

The master controller 19 has the functions of monitoring the bin microcontrollers 90 of a plurality of bins 11 for ticket dispensing activity, recording such activity in nonvolatile memory, allowing printouts of sales and auditing reports, and system administration tests such as loading bin counts, assigning PIN numbers, etc. The master controller 19 poles each of the bin microcontrollers 90 via two synchronous serial buses using a compact protocol to allow for high speed operation. The bin microcontroller 90 is responsible for keeping a real time count and reporting back incremental numbers of tickets dispensed, which are then recorded by the controller 19 and subtracted from the inventory.

With the length of the lottery tickets 12 programmed into the microcontroller 90, it is a simple matter for translation of the measurements provided by the friction wheel assembly 45 into the number of lottery tickets dispensed during any desired time period. Preferably, to insure that a ticket is counted accurately, it is desirable that the microcontroller 90 will have a forward and reverse allowance in its ticket count so that a ticket does not have to be at its exact end point before it will be counted. This allowance is similar to a tolerance in that it allows for a ticket to be counted at a point slightly plus or minus of its end point to increase the accuracy of the ticket count. In view of the small margin of profit a retailer is provided for the sale of lottery tickets it is essential for the accuracy of the apparatus 10 to be essentially error free. The use of the friction wheel assembly 45 by itself, does not provide error free count due to variation in ticket length and mechanical variations. This is the reason for the use of the optical sensing element 55 that is preferably utilized to serve as a second ticket counting means. By the use of the element 55 the accuracy of the apparatus 10 is increased so as to be virtually error free.

In operation, the optical sensing element 55 is preferably utilized for recalibrating the count provided by the friction wheel assembly 45. Due to variations in the length of the tickets 12 and mechanical variations it is possible that the count provided by the friction wheel assembly 45 will not be accurate. Although any error will be slight for the measurement of a single ticket 12, if the count provided by the assembly 45 is not reset or calibrated at periodic intervals, the error can accumulate as multiple tickets 12 are dispensed until the error reaches the point that it affects the accuracy of the ticket count.

Figure 15:
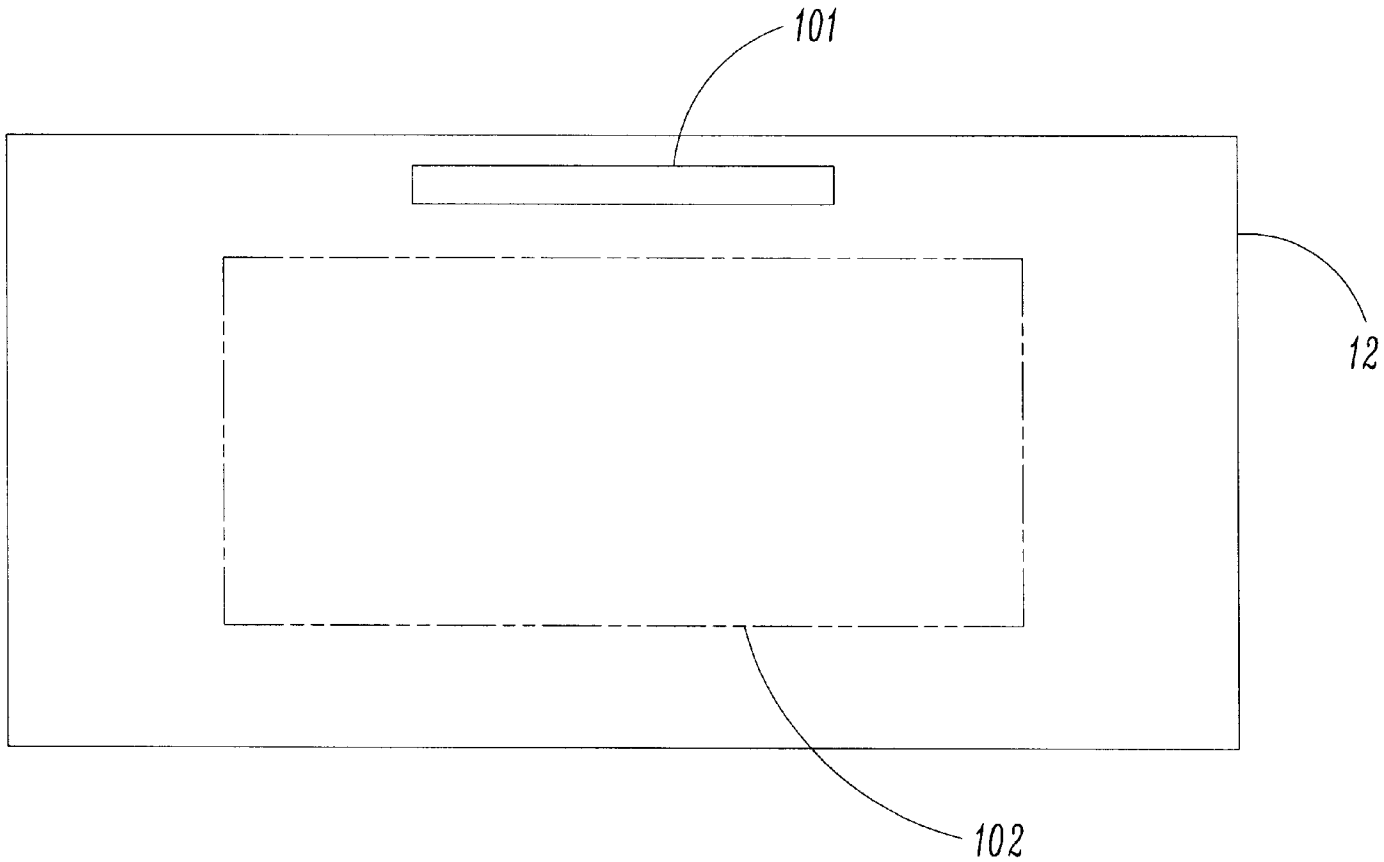
FIG. 15 is a plan view of a typical lottery ticket dispensed by the apparatus of FIG. 1.

To accomplish its recalibrating function, the optical sensing element 55 operates based upon a sensing of a single dark colored stripe 101 on each of the tickets 12 (as indicated in FIG. 15) rather than a measurement of such tickets, the accuracy of the counting information provided by the element 55 is not affected by any mechanical variance between the friction wheel assembly 45 and the tickets 12. However, because a standard lottery ticket may have a variety of indicia 102 printed on it, in addition to one of the stripes 101 the apparatus 10 is designed to be able to discriminate between such other indicia 102 and the stripes 101.

When the optical sensing element 55 is not utilized to provide an actual count of the tickets 12, but only serves to recalibrate the count provided by the friction wheel assembly 45, it is not essential that the element 55 sense each of the ticket stripes 101. Nevertheless, it is important for proper operation of the apparatus 10 that the element 55 provide a reset of the count of the friction wheel assembly 45 as a result of the actual sensing of a stripe 101. Accordingly, the electronic circuitry of the microcontroller 90 includes a number of safeguards to insure that the friction wheel assembly count is reset only when the optical sensing element 55 has properly sensed a stripe 101.

The safeguards include the use of a stripe discrimination, encoder movement and encoder correction algorithms to permit resetting of the count of the friction wheel assembly 45 only if the optical sensing element 55 has sensed a stripe at a time when the friction wheel assembly 45 indicates that the spacing between two consecutive stripes 101 being sensed is appropriate to the width of a lottery ticket as will now be described.

Figure 16:
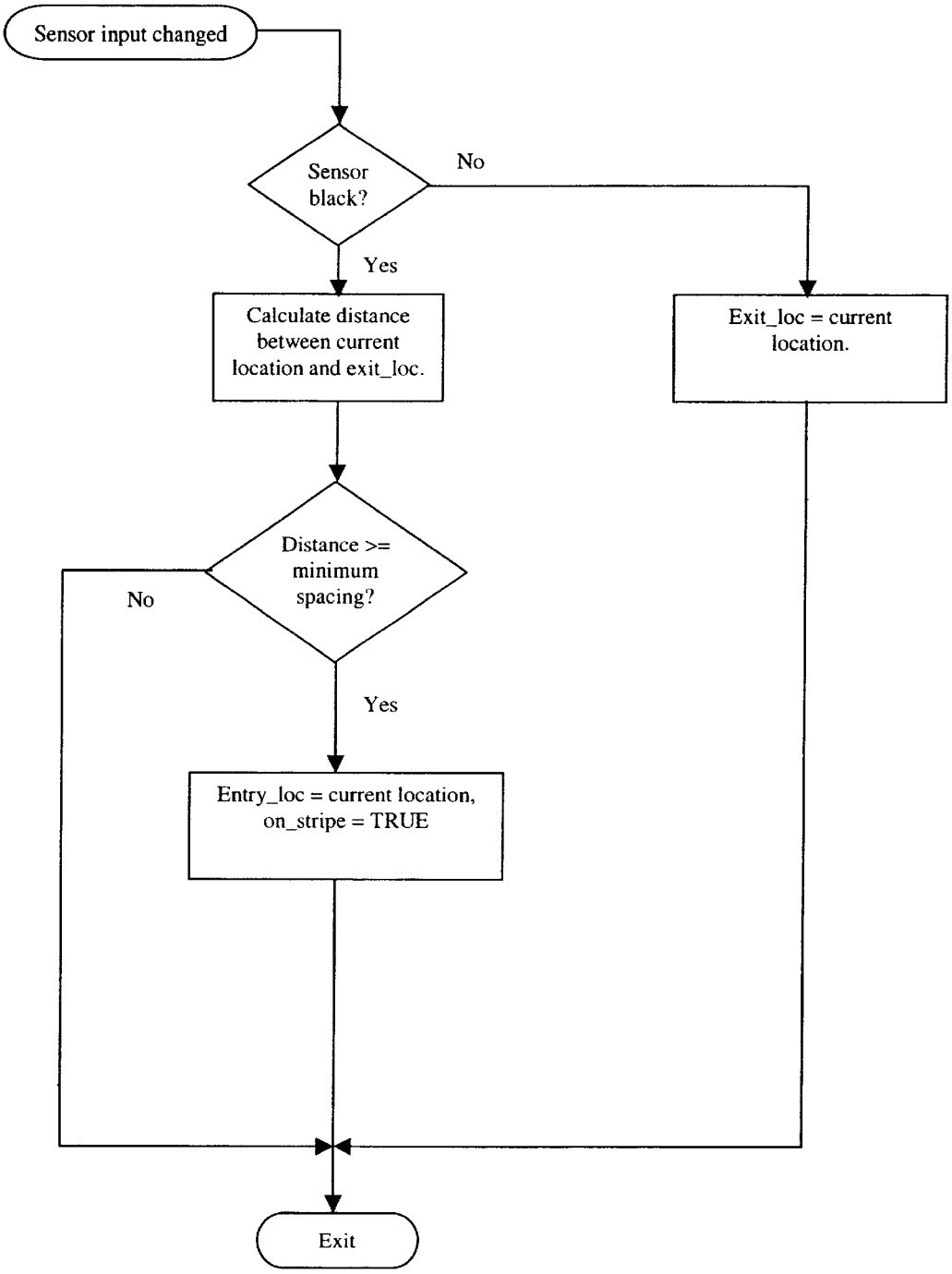
FIG. 16 is a flow chart showing a sensor stripe discrimination algorithm utilized by the apparatus of FIG. 1.

Referring now to FIG. 16 which shows the stripe discrimination algorithm (SDA), the purpose of such algorithm is to remove noise from the edge of the stripes 101. As the tickets 12 pass through the tear bar assembly 18, each of the stripes 101 are detected by the optical sensing element 55, which has an analog voltage output. The output voltage of the element 55 is fed into the signal conditioning and biasing network 98 and then to a comparator included in the microcontroller 90, along with a software-adjustable threshold voltage. Any voltage on one side of the threshold produces a digital 1 output, while voltages on the other side of the threshold produce a 0.

Whenever the output of the comparator changes, either 1 to 0 or 0 to 1, the stripe discrimination algorithm (SDA) runs. Around the edges of the stripes 101, the optical sensing element 55 may change state many times due to noise before settling on the correct value and the purpose of the SDA is to filter out these noise signals. The SDA does this by recording the location (based on encoder wheel assembly count) of each falling (1 to 0, or black to white) transition. When it sees a rising transition (0 to 1, or white to black) it looks at the last falling location and if the distance between the two is too small (typically 3–4 encoder ticks minimum) it ignores such transition. The end result is that the rising transitions are only considered stripes if they are at least a minimum distance apart corresponding to the width of one of the tickets 12.

Figure 17:
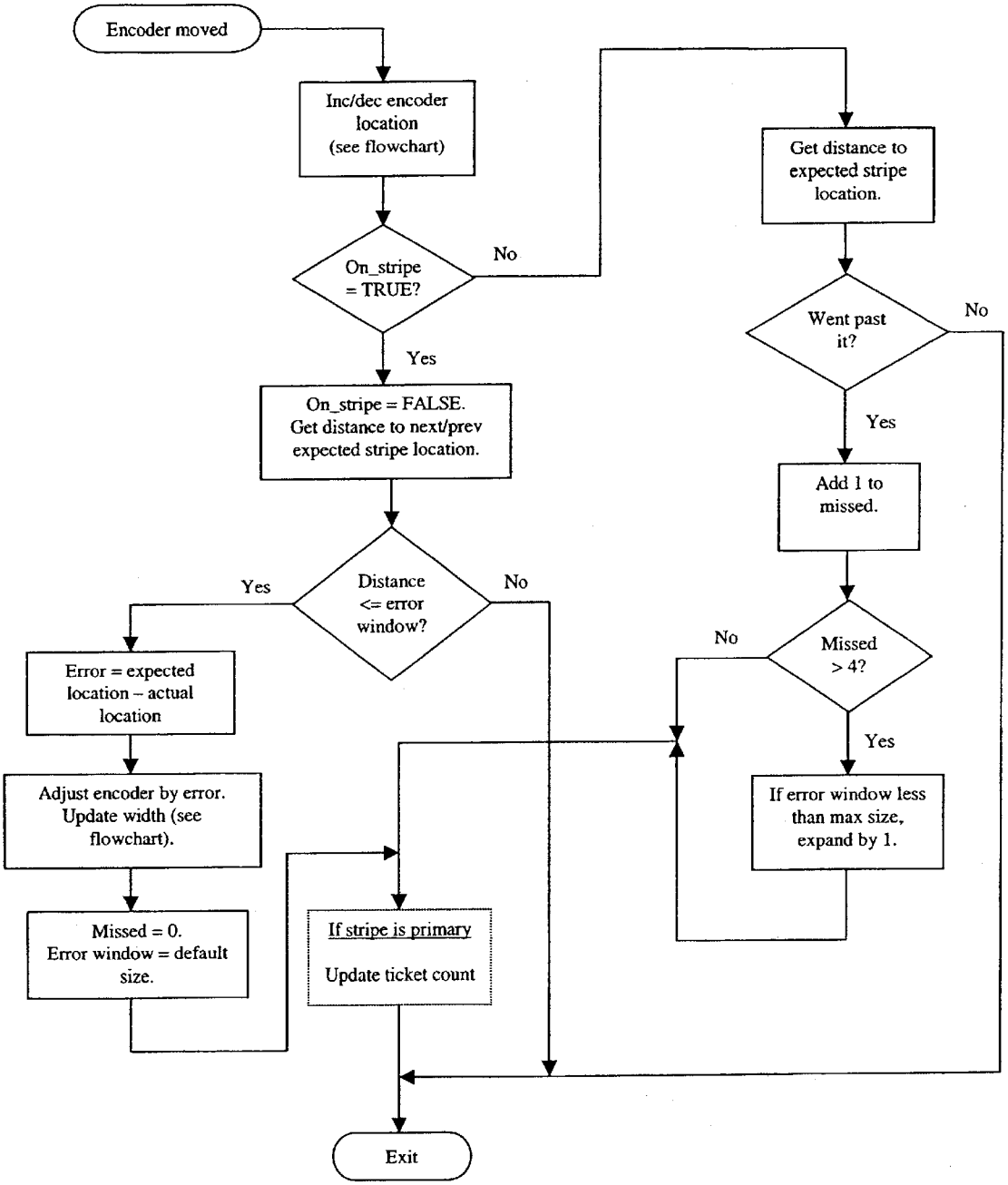
FIG. 17 is a flow chart showing an encoder correction algorithm utilized by the apparatus of FIG. 1.

A second safeguard utilized by the apparatus 10 is the encoder correction algorithm (ECA) shown in FIG. 17 which uses the stripes 101 detected by the optical sensing element 55 to adjust the count of the encoder assembly 48 so as to eliminate errors due to fractional ticket widths and mechanical encoder and ticket tolerances. The encoder assembly 48 is considered locally correct, while the stripes 101 are unreliable locally (may not all be seen) but correct overall. The ECA is able to operate when one or more of the stripes 101 are missed or extraneous "stripes" are seen, but when a real stripe 101 is seen, the ECA uses the stripe location to override the current encoder count.

Preferably, the location of the first stripe 101 on the ticket 12 is known when the tickets 12 are loaded. The encoder wheel assembly 48 maintains the expected location of the next stripe 101 in both the forward and reverse directions at all times. These locations are always two ticket widths apart, so if direction is reversed right after a stripe 101 is passed, the same stripe 101 will not be seen a second time.

Each time the encoder wheel 49 moves, the ECA checks to see if the optical sensing element 55 indicates that one of the stripes 101 is detected (the ECA sets a flag TRUE in this case, but never clears the flag). If a stripe 101 is detected, the ECA clears the stripe flag to FALSE, then checks to see if the current location is within an error window around the expected stripe location. The error window defaults to approximately the width of a stripe 101 plus the white margin on each side (about 9 encoder ticks). The purpose of the window is to discriminate between the actual stripe 101 and other features that cause the sensing element 55 to indicate black. If the current stripe 101 is within the error window, the encoder count is adjusted to the expected location, and new expected locations for both forward and reverse direction stripes 101 are calculated. If the optical sensing element 15 is utilized to serve as the primary means of ticket counting, the ticket count is incremented or decremented at this point, depending on the direction of movement of the encoder wheel assembly 48.

If no stripe 101 is currently detected, the ECA checks to see if the current location has surpassed the expected stripe location (plus the error window). If so, the stripe is considered "missed" and a missed count is incremented. If the missed count becomes too large (currently 5 missed stripes in a row) the sensing element 55 is considered "lost" and the error window is expanded by one encoder count in each direction. On every consecutive missed stripe after that, the error window continues to grow until it reaches a maximum allowed size (currently double the default size). Once a stripe 101 is seen within the window, the missed count is cleared to zero and the error window is reset to the default size. If the sensing element 55 is the primary ticket counting means, the ticket count is updated each time a lost stripe is counted.

Because the apparatus 10 is dependent upon the ticket width when lost, and because the theoretical ticket width may be off by several percent (due to mechanical tolerances in the tickets and/or the encoder wheel assembly 48) the ECA also dynamically adjusts the ticket width as it sees the stripes 101. When the error between the stripe location and the expected location is more than one encoder count, the ticket width is adjusted by 1. This adjustment continues as long as errors greater than 1 are seen in the encoder count. Once the ticket width is stabilized (10 tickets in a row have an error less than 2 encoder counts) the ticket width is "frozen." This prevents the ticket width from being changed inadvertently when tickets are skewed in the holder. This is especially important for tickets that are narrower than the ticket dispenser, and are able to move around as they are pulled.

Figure 18:
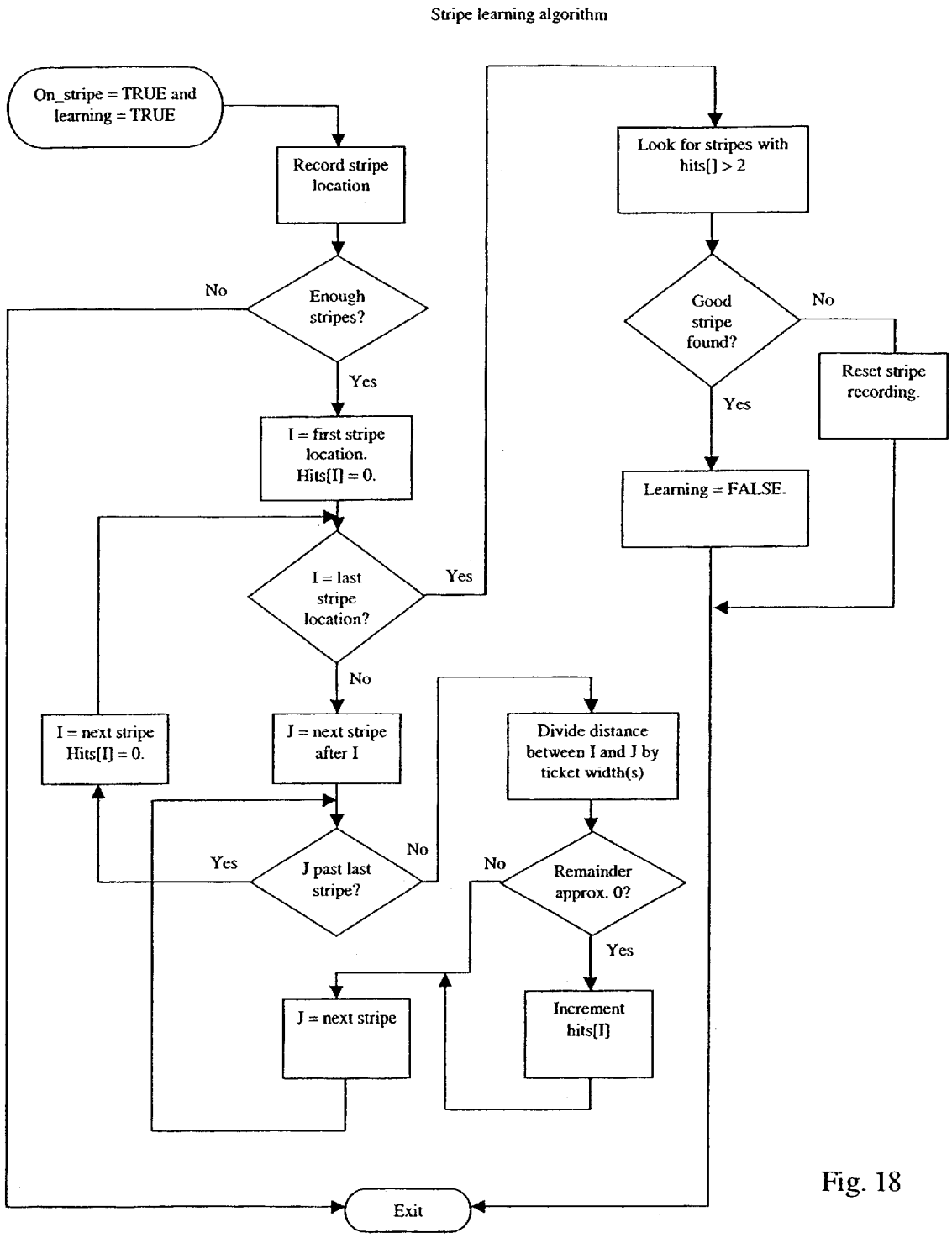
FIG. 18 is a flow chart showing a stripe leaming algorithm that may be utilized by the apparatus of FIG. 1.

The ECA is dependent upon the location of the stripes 101 on the tickets 12 being known. However the apparatus 10 may be adapted to include a stripe learning algorithm (SLA) to eliminate such requirement and permit the apparatus 10 to find the stripes 101 on its own, without making any initial assumptions other than that the stripes 101 are spaced a ticket width apart. This is called "leaming" and the SLA is shown in FIG. 18. The general strategy is to accumulate the locations of all dark features on the cards during the first dozen or so tickets pulled from the apparatus 10 and then to search through the data for a set of features that are an integral number of ticket widths apart.

In the apparatus 10 utilizing the SLA, the leaning flag is initialized to TRUE whenever the tickets 12 are loaded or the ECA becomes "lost." The SLA then records the stripe entry location (rising edge, or white-black transition) of each black feature that passes the stripe discrimination algorithm.

After a certain number of features is recorded, or a certain number of tickets 12 have passed (assuming a required minimum number of features have been seen), the ECA takes each stripe 101, starting with the most recent, and looks back through all previous stripes 101, checking whether the distance between the current and the questionable previous stripes 101 are an integral number of ticket widths apart, plus an error (one error window per ticket width apart). If the test passes, a hit counter for the current stripe 101 is incremented and the algorithm moves on until it runs out of the previous stripes 101. It then moves to the next most recent stripe 101 and repeats. In the end, when each of the stripes 101 has been compared to every stripe 101 before it, the hit counters are examined and the stripe 101 with the highest hit count is assumed to be the most recently seen "valid" stripe 101, and is used for all further calculation. If none of the stripes 101 is found with a hit count higher than some minimum required value, the learning clears out all the saved stripe locations and begins accumulating a new set.

Thus, the present invention provides a novel and efficient ticket dispensing apparatus for accurately detecting and counting the number of tickets dispensed from the apparatus. Although the present invention has been described with respect to a preferred embodiment, it should be understood by those skilled in the art that such embodiment may be altered without departing from the true spirit and scope of the invention.

What is claimed is:

1. An apparatus for the storage, display and dispensing of tickets and for the accounting of tickets dispensed from the apparatus, said apparatus comprising:

(a) a bin housing for storing a pack of tickets sequentially connected together by perforated joinder lines that define the edges of each ticket, said bin housing including a dispensing end and an opposite end;

(b) said tickets each having indicia located thereon and formed of ticket counting indicia and miscellaneous ticket indicia;

(c) a ticket dispensing assembly located at the dispensing end of said bin housing and having a ticket dispensing slot through which said tickets are dispensed from said bin housing;

(d) a first ticket counting means associated with said dispensing assembly for counting the number of tickets dispensed from said apparatus and providing an electronic signal representative of said number;

(e) a second ticket counting means associated with said dispensing assembly for detecting said ticket counting indicia on said tickets and for calibrating the accuracy of said first counting means; and (f) computer processing means for receiving said electronic signals from said first and second counting means and for providing ticket count information in response thereto.

2. A dispensing apparatus as recited in claim 1, wherein said first ticket counting means is in the form of a friction wheel that presses against the tickets as they pass through the dispensing assembly.

3. A ticket dispensing apparatus as recited in claim 1, wherein said second ticket counting means includes an optical sensing means that detects the indicia on the tickets as they pass through said dispensing assembly.

4. A ticket dispensing apparatus as recited in claim 3, wherein said apparatus further includes means for distinguishing the difference between said ticket counting indicia and said miscellaneous ticket indicia and for resetting said first ticket counting means upon detecting the former.

5. A ticket dispensing apparatus as recited in claim 1, wherein said dispensing assembly includes a cover with top plate and a bottom plate closely aligned together to form said ticket dispensing slot therebetween through which said tickets pass through for counting thereof by said first and second ticket counting means.

6. A ticket dispensing apparatus as recited in claim 4, wherein said lower plate of said ticket guide has a first aperture through which said first counting means extends to engage said tickets and a second aperture through which the second counting means detects said indicia.

7. A ticket dispensing apparatus as recited in claim 1, wherein said first ticket counting means includes an optical encoder means associated with said friction wheel.

8. A ticket dispensing apparatus as recited in claim 6, wherein said optical encoder means is formed of an encoder wheel and, a light emitting diode means that transmits a beam of light toward one side of said encoder wheel and a light sensing means on the opposite side of said encoder wheel for receiving light that passes through said wheel.

9. An apparatus for the storage, display and dispensing of tickets and for the accounting of tickets dispensed from the apparatus, said apparatus comprising:

(a) a bin housing for storing a pack of tickets sequentially connected together by perforated joinder lines that define the edges of each ticket, said bin including a dispensing end and an opposite end;

(b) said tickets each having indicia located thereon and formed of ticket counting indicia and miscellaneous ticket indicia;

(c) a ticket dispensing assembly located at the dispensing end of said bin housing and having a ticket dispensing slot through which said tickets are dispensed from said bin housing; and (d) ticket counting means associated with said tear bar bin assembly for detecting the ticket counting indicia on said tickets and providing electronic signals representative of a count of the number of tickets dispensed from said apparatus.

10. A dispensing apparatus as recited in claim 9, wherein said ticket counting means includes a friction wheel that presses against the tickets as they pass through said dispensing assembly.

11. A dispensing apparatus as recited in claim 10, wherein said apparatus further includes guide means located in the opposite end of said bin housing and around which said tickets are trained.

12. A ticket dispensing apparatus as recited in claim 10, wherein said dispensing assembly includes a top plate and a bottom plate closely aligned together to form a narrow slot therebetween through which said tickets pass through for counting thereof by said ticket counting means.

13. A ticket dispensing apparatus as recited in claim 9, wherein said apparatus includes computer means for discriminating between said ticket counting indicia and said miscellaneous ticket indicia and upon sensing of said ticket counting indicia provides an output signal that assists in the counting of said tickets.

14. A ticket dispensing apparatus as recited in claim 9, wherein said apparatus further includes computer means that discriminates between said ticket counting indicia and said miscellaneous ticket indicia by determining the distance between the ticket counting indicia of two consecutive tickets and providing ticket count information if such distance substantially corresponds to the actual distance between such ticket counting indicia.

15. A ticket dispensing apparatus as recited in claim 14, wherein the location of said ticket counting indicia on said tickets is known by said computer means.

16. A dispensing apparatus as recited in claim 14, wherein said ticket counting indicia is initially unknown by said computer means and said computer means performs a stripe learning algorithm for discriminating between said ticket counting information and said miscellaneous ticket information.

17. A dispensing apparatus as recited in claim 9, wherein said ticket counting means includes an optical sensing means that senses the ticket counting indicia on said tickets and provides a ticket count in response thereto.

* * * * *